US010581147B1

(12) United States Patent
West

(10) Patent No.: US 10,581,147 B1
(45) **Date of Patent: *Mar. 3, 2020**

(54) ARBITRARY POLARIZATION CIRCULAR AND CYLINDRICAL ANTENNA ARRAYS

(71) Applicant: Rockwell Collins, Inc., Cedar Rapids, IA (US)

(72) Inventor: James B. West, Cedar Rapids, IA (US)

(73) Assignee: ROCKWELL COLLINS, INC., Cedar Rapids, IA (US)

( * ) Notice: Subject to any disclaimer, the term of this patent is extended or adjusted under 35 U.S.C. 154(b) by 199 days.

This patent is subject to a terminal disclaimer.

(21) Appl. No.: 15/413,052

(22) Filed: Jan. 23, 2017

(51) Int. Cl.

| | |
|---|---|
| ***H01Q 1/38*** | (2006.01) |
| ***H01Q 9/28*** | (2006.01) |
| ***H01Q 13/10*** | (2006.01) |
| ***H01Q 13/08*** | (2006.01) |
| ***H01Q 21/20*** | (2006.01) |
| ***H01Q 1/28*** | (2006.01) |
| *H01Q 25/00* | (2006.01) |
| *H01Q 5/00* | (2015.01) |

(52) U.S. Cl.
CPC ..... *H01Q 1/38* (2013.01); *H01Q 1/28* (2013.01); *H01Q 9/28* (2013.01); *H01Q 13/085* (2013.01); *H01Q 13/10* (2013.01); *H01Q 21/205* (2013.01); *H01Q 5/00* (2013.01); *H01Q 25/00* (2013.01)

(58) Field of Classification Search
CPC .. H01Q 1/38; H01Q 1/28; H01Q 9/28; H01Q 13/085; H01Q 13/10
USPC ..... 343/700 R
See application file for complete search history.

(56) References Cited

U.S. PATENT DOCUMENTS

| | | | | |
|---|---|---|---|---|
| 4,001,834 A * | 1/1977 | Smith | H01Q 13/08 | 333/238 |
| 4,782,346 A * | 11/1988 | Sharma | H01Q 13/085 | 343/772 |
| 6,421,021 B1 * | 7/2002 | Rupp | H01Q 13/085 | 343/753 |
| 6,765,535 B1 * | 7/2004 | Brown | H01Q 3/46 | 343/700 MS |

(Continued)

FOREIGN PATENT DOCUMENTS

| | | |
|---|---|---|
| EP | 1 693 922 A1 | 8/2006 |
| WO | WO-2007/047567 | 4/2007 |

OTHER PUBLICATIONS

European Search Report for EP Application No. 18075006.9 dated Oct. 1, 2018. 9 pages.

(Continued)

*Primary Examiner* — Huedung X Mancuso
(74) *Attorney, Agent, or Firm* — Donna P. Suchy; Daniel M. Barbieri

(57) ABSTRACT

An antenna is used in a radar, sensor, communication, discovery, electronic warfare and/or networking system. The antenna system includes a disc-shaped conductive substrate, a ring-shaped conductive substrate being positioned generally parallel with respect to the disc-shaped conductive substrate, the ring-shaped conductive substrate having an outer diameter generally coincides with an outer diameter of the disc-shaped conductive substrate. Antenna elements, such as, Balanced Antipodal Vivaldi Antenna (BAVA) elements, are disposed between the disc-shaped conductive substrate and the ring-shaped conductive substrate.

20 Claims, 7 Drawing Sheets

(56) References Cited

U.S. PATENT DOCUMENTS

| | | | | |
|---|---|---|---|---|
| 6,831,610 | B2 | 12/2004 | Quagliaro | |
| 6,844,855 | B2 | 1/2005 | Carson | |
| 6,999,022 | B1 | 2/2006 | Vesel et al. | |
| 7,624,951 | B1 | 12/2009 | Kraft et al. | |
| 8,182,103 | B1 * | 5/2012 | Brown | H01L 23/66 359/849 |
| 8,736,504 | B1 | 5/2014 | West et al. | |
| 8,963,790 | B2 * | 2/2015 | Brown | H01P 1/061 333/256 |
| 9,455,500 | B1 | 9/2016 | West et al. | |
| 9,647,748 | B1 | 5/2017 | Mitchell | |
| 9,716,309 | B1 | 7/2017 | Elsallal | |
| 9,843,107 | B2 | 12/2017 | Corman et al. | |
| 9,848,370 | B1 | 12/2017 | Freedman et al. | |
| 2006/0202777 | A1 * | 9/2006 | Deckman | H03F 3/602 333/125 |
| 2013/0088391 | A1 | 4/2013 | Corman et al. | |

OTHER PUBLICATIONS

Non-Final Office Action for U.S. Appl. No. 15/600,497 dated Apr. 25, 2018. 9 pages.
Notice of Allowance for U.S. Appl. No. 15/600,497 dated Sep. 21, 2018. 5 pages.
Non-Final Office Action for U.S. Appl. No. 15/403,134 dated Feb. 21, 2019. 12 pages.
Notice of Allowance for U.S. Appl. No. 15/403,134 dated Nov. 27, 2019. 2 pages.
Office Action for Brazil Patent Application No. 102018009865.9 dated Oct. 4, 2019. 6 pages.
Second Office Action for CN Patent Application No. 201810455550.0 dated Oct. 23, 2019. 5 pages.

* cited by examiner

ARBITRARY POLARIZATION CIRCULAR AND CYLINDRICAL ANTENNA ARRAYS

TECHNICAL FIELD

The present disclosure relates generally to antenna arrays and more particularly to a circular or cylindrical antenna arrays, such as, circular or cylindrical Balanced Antipodal Vivaldi Antenna (BAVA) arrays.

BACKGROUND

Modern sensing and communication systems may utilize various types of antennas to provide a variety of functions. For example, radar systems use antenna arrays to perform functions including but not limited to, intelligence-gathering (e.g., signals intelligence, or SIGINT), direction finding (DF), electronic countermeasure (ECM) or self-protection (ESP), electronic support (ES), electronic attack (EA) and the like. Providing multi-function capability from a single aperture to modern platforms is an important requirement. However, due to the limited space available on size-constrained platforms such aerial vehicles or the like, placing the various types of antennas is becoming a challenge. U.S. patent application Ser. No. 13/494,517, incorporated herein by reference in its entirety and discloses a vertically polarized array.

SUMMARY

In one aspect, embodiments of the inventive concepts disclosed herein are directed to an arbitrary polarization circular or cylindrical antenna array. The array includes a first conductive substrate, a second conductive substrate, and Balanced Antipodal Vivaldi Antenna (BAVA) elements. The second conductive substrate is positioned generally parallel with respect to the first conductive substrate, and the second conductive substrate has an outer diameter generally coincides with an outer diameter of the first conductive substrate. The Balanced Antipodal Vivaldi Antenna (BAVA) elements are disposed between the first conductive substrate and the second conductive substrate and form a circular antenna array along edges of the first conductive substrate and the second conductive substrate. The first conductive substrate and the second conductive substrate jointly form a parallel plate waveguide for the circular antenna array. The BAVA elements are disposed at a slant angle with respect to the first conductive substrate, wherein the BAVA elements are disposed perpendicular to the first conductive substrate, or wherein the BAVA elements comprise a first element disposed at a first angle with respect to the conductive substrate and a second element disposed at a second angle with respect to the first conductive substrate different from the first angle.

In one aspect, embodiments of the inventive concepts disclosed herein are directed to an antenna system. The antenna system includes a disc-shaped conductive substrate, a ring-shaped conductive substrate being positioned generally parallel with respect to the disc-shaped conductive substrate, and BAVA elements. The ring-shaped conductive substrate has an outer diameter that generally coincides with an outer diameter of the disc-shaped conductive substrate. The Balanced Antipodal Vivaldi Antenna (BAVA) elements are disposed between the disc-shaped conductive substrate and the ring-shaped conductive substrate. The BAVA elements form a circular antenna array along edges of the disc-shaped conductive substrate and the ring-shaped conductive substrate. The disc-shaped conductive substrate and the ring-shaped conductive substrate jointly form a parallel plate waveguide for the circular antenna array. The BAVA elements are disposed at a 45 degree angle with respect to the conductive substrate or the BAVA elements comprise a first element disposed at a first angle with respect to the conductive substrate and a second element disposed at a second angle with respect to the conductive substrate different from the first angle.

In another aspect, embodiments of the inventive concepts disclosed herein are directed to an antenna system. The antenna system includes a first conductive substrate, a second conductive substrate being positioned generally parallel with respect to the first conductive substrate, a third conductive substrate, a first row of Balanced Antipodal Vivaldi Antenna (BAVA) elements disposed between the first conductive substrate and the second conductive substrate, and a second row of BAVA elements disposed between the third conductive substrate and the second conductive substrate. The second conductive substrate defining an outer perimeter that generally coincides with an outer perimeter of the first conductive substrate, and the third conductive substrate defines an outer perimeter that generally coincides with an outer perimeter of the first conductive substrate.

In another aspect, embodiments of the inventive concepts disclosed herein are directed to an antenna system. The antenna system includes a first transmit aperture and a second receive aperture. The first transmit aperture includes a first conductive substrate, a second conductive substrate positioned generally parallel with respect to the first conductive substrate, and first Balanced Antipodal Vivaldi Antenna (BAVA) elements disposed between the first conductive substrate and the second conductive substrate. The second receive aperture is stacked with respect to the transmit aperture and includes a third conductive substrate, a fourth conductive substrate generally parallel to the third conductive substrate, and second BAVA elements disposed between the third conductive element and the fourth conductive element.

BRIEF DESCRIPTION OF THE DRAWINGS

Exemplary embodiments will become more fully understood from the following detailed description, taken in conjunction with the accompanying drawings, wherein like reference numerals refer to like elements, and the numerous objects and advantages of the embodiments may be better understood by those skilled in the art by reference to the accompanying figures in which.

DETAILED DESCRIPTION

Figure 1:
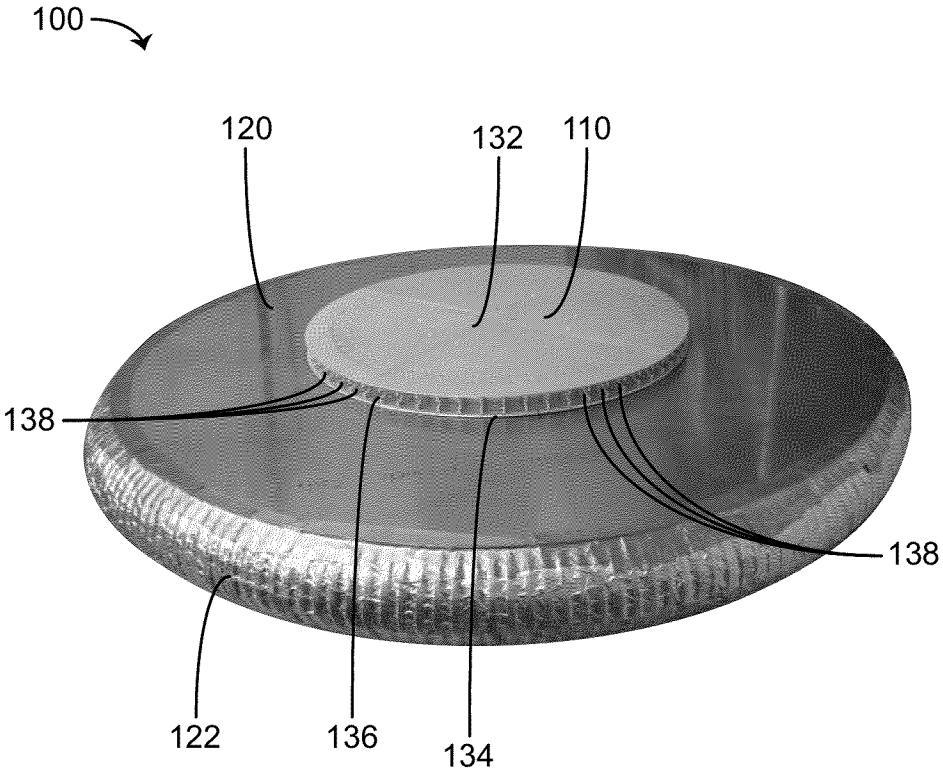
FIG. 1 is a perspective view of an antenna system in accordance with some embodiments.

Reference will now be made in detail to exemplary embodiments of the disclosure, examples of which are illustrated in the accompanying drawings.

The present disclosure is directed to a radar, sensing, communication, discovery and/or networking system that utilizes an antenna system including circular, cylindrical, or elliptical array of antenna elements (e.g., Balanced Antipodal Vivaldi Antenna elements) to support very broad bandwidth operations utilizing a low-profile aperture. It is contemplated that such configurations may be applied to linear arrays (i.e., with no curvature) as well. The antenna system in accordance with the present disclosure may be installed on a size-constrained platform and utilized as a common shared asset aperture, providing multifunctional, multi-beam support to facilitate multiband communications.

In some embodiments, an arbitrary polarization, ultra-wide band (UWB) circular or cylindrical array is provided. The polarization includes but is not limited to one or more of: dual orthogonal linear (DOLP) polarization, right and left hand circular polarization (RHCP, LHCP), or right and left hand elliptical polarization (RHEP, LHEP). The bandwidth can be greater than 5:1 instantaneous bandwidth (IBW). In some embodiments, the array provides omnidirectional and directional modes in azimuth and provides shaped beams in elevation. Simultaneous, omnidirectional and directional multiple beams are provided using digital beam formers (DBF) and UWB analog beam formers in some embodiments.

In some embodiments, UWB circular array technology is configured for arbitrary polarization and stacking is used to form cylindrical arrays. The output of the parallel plate aperture of the circular array is shaped to a contour for elevation pattern shaping in some embodiments. In some embodiments, transmit (Tx) and (Rx) arrays are combined or stacked. In some embodiments, ground plane shaping, radio frequency (RF) choking and material/metamaterial loading is used to improve Tx-to-Rx isolation in closely located, but separate Rx/Rx arrays. In some embodiments, a common UWB Tx/RX array, separate, but closely located (e.g. "stacked") Rx and Tx arrays, and/or separate, but close located sub-banded arrays are provided.

In some embodiments, arbitrary polarized array embodiments include a vertical polarized (VP) parallel plate array stacked on a horizontal polarized (HP) parallel plate, or vice versa, an array for dual orthogonal linear polarization (DOLP), separate HP and VP elements within a common parallel plate waveguide at two times the circular array lattice density, separate slant (e.g., 45 degree) DOLP elements within a common parallel plate waveguide at two times the circular array lattice density, coincident phase center HP and VP elements within a common parallel plate waveguide, and coincident phase center slant elements within a common parallel plate waveguide. Various radiating elements can be utilized the circular or cylindrical arrays in some embodiments. Arbitrary linear polarized circular array radiating elements include but are not limited to: multi-beam circular array (MCA) BAVA elements, multi-function electronic warfare (MFEW) all metal elements, coincident phase center DOLP BAVA elements, Vivaldi elements, all metal Vivaldi elements, coincident phase center DOLP Vivaldi elements, all metal NRL coincident phase center Vivaldi elements, NRL sliced Vivaldi elements for improved diagonal plane (D-plane) polarization performance, coincident phase center DOLP sliced Vivaldi elements, DOLP frequency-scaled ultra-wide spectrum elements (FUSEs) (e.g., such those manufactured by the MITRE company, and coincident phase center FUSEs. Note that Although the end fire UWB BAVA, Vivaldi and FUSE-based radiating elements are discussed for the arbitrarily polarized circular, stacked circular and cylindrical array embodiments described herein, other end-fire Ultra-Wide Band (UWB) elements can be incorporated into the parallel plate, stacked and flared aperture array concepts described herein.

Referring to FIG. 1, an antenna system 100 for a radar system includes an antenna array 110 (e.g., a disc-shaped MCA) disposed on a ground plane 120. The radar system is a communication radar system, sensing radar system, or electronic warfare radar system in some embodiments. The ground plane 120 includes a rolled edge 122 and can have a radius of four feet in some embodiments. The ground plane 120 shown in FIG. 1 is for antenna pattern measurement use and is not part of the antenna array 110. The antenna array 110 is mounted on the metallic surface of an air, maritime or ground vehicle, a mount structure, tower, pole, etc. without the ground plane 120 in some embodiments.

The antenna array 110 includes a conductive substrate or medium 132 and a ring-shaped conductive substrate or medium 134 positioned generally parallel with respect to each other. In addition, the outer diameter of the ring-shaped conductive medium 134 coincides with the outer diameter of the disc-shaped conductive medium 132 in some embodiments. An area 136 is disposed between the ring-shaped conductive medium 134 and the disc-shaped conductive medium 132. The area 136 includes radiating or antenna elements 138, such as slanted elements (e.g., 45 degrees with respect to the ring-shaped conductive medium 134 and the disc-shaped conductive medium 132) or vertical elements in some embodiments. In some embodiments, additional antenna arrays (e.g., similar to the array 110) are stacked on top of the antenna array 110.

In some embodiments, the antenna elements 138 in the area 136 are BAVA elements disposed between the disc-shaped conductive medium 132 and the ring-shaped conductive medium 134. In some embodiments, the BAVA element uses an exponential flare of a three conductor slot line to slowly rotate the opposing electric field vectors of the triplate (stripline) mode into substantially parallel vectors for which the cross-polarized portions cancel in the boresight direction, and the co-polarized E-field portion propagates into the free-space. The antenna elements 138 can be circuit board based elements or metal structures in an insulated frame.

Figure 2:
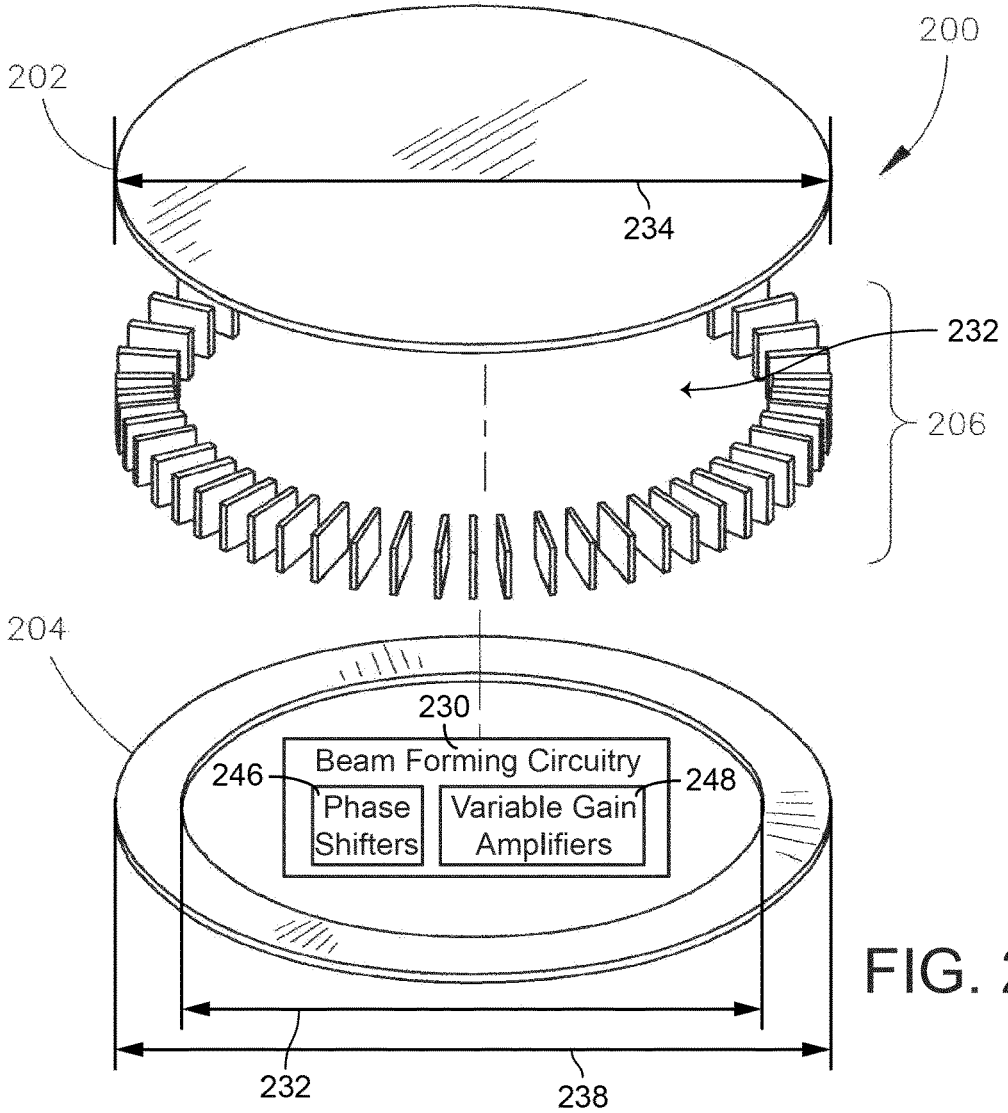
FIG. 2 is an exploded schematic view of an antenna system in accordance with some embodiments.
Figure 3:
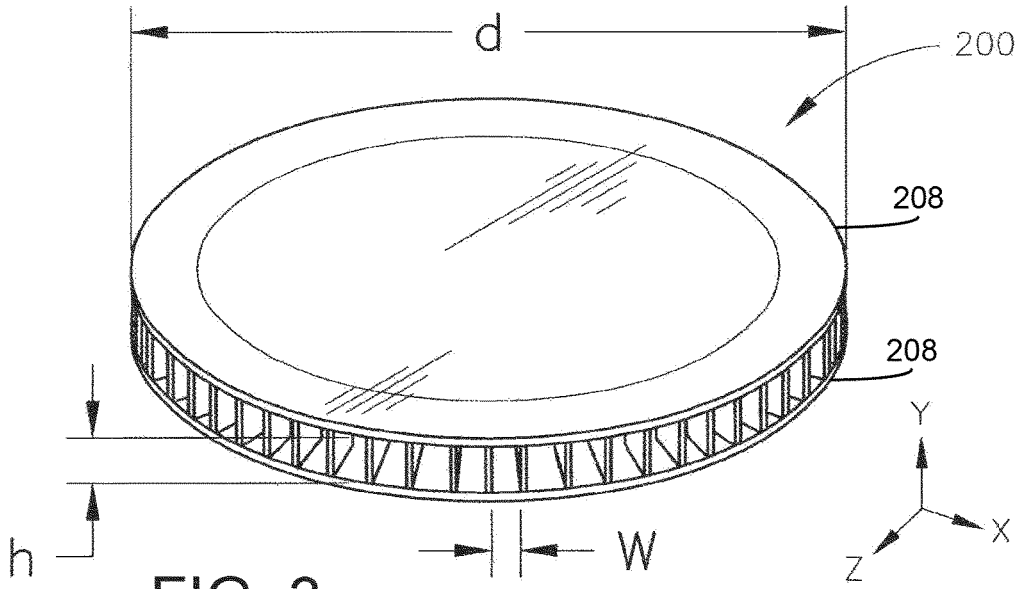
FIG. 3 is a perspective view of the antenna system of FIG. 2.

Referring to FIGS. 2 and 3, an antenna system 200, similar to the antenna system 100, includes a disc-shaped conductive substrate 202 and a ring-shaped conductive substrate 204 positioned generally parallel with respect to each other. In addition, an outer diameter 234 of the ring-shaped conductive substrate 204 coincides with an outer diameter 238 of the disc-shaped conductive substrate 202.

The antenna system 200 also includes radiating or antenna elements 206 (e.g., BAVA elements) disposed between the disc-shaped conductive substrate 202 and the ring-shaped conductive substrate 204. In some embodiments, the antenna elements 206 are slanted, horizontal, vertical elements or combinations thereof. BAVAs are discussed in J. D. Langely et al, "Balanced Antipodal Vivaldi Antenna for Wide Bandwidth Phased Arrays," IEEE Proceeding of Microwave and Antenna Propagations, Vol. 143, No. 2, Apr. 1996, pp. 97-102.

In some embodiments, the antenna elements 206 are arranged to form a circular antenna array along the edges 208 of the conductive substrates 202 and 204. The conductive substrates 202 and 204 jointly form a parallel plate waveguide for the circular antenna array or a cylindrical array. In some embodiments a second ring 204 can be used as a replacement to conductive substrate 20. This approach leverages the unique properties of the electromagnetic image theory to employ mutual coupling of BAVA elements in an array environment, enabling wideband operation and size reduction of the radiating elements (i.e., low physical profile) in some embodiments.

The two array parameters are configured for providing multiband coverage ranging from ultra-high frequency (UHF) to C-band. For instance, the E-plane spacing, denoted as h in FIG. 2, sets the parallel plate and the BAVA aperture heights. The H-plane spacing, denoted as W in FIG. 2, determines the frequencies at which grating lobes enter real space and also control mutual coupling between neighboring elements. In one embodiment, the E-plane spacing, h, may be configured to be approximately 1 inch, which equals $0.07\times\lambda$, at 830 MHz, the lowest operating frequency to be supported by the radar system associated with the antenna system 200. The H-plane spacing, W, is configured to be approximately 1.2 inches, which equals to $0.5\times\lambda$ at 5 GHz, the highest operating frequency to be supported by the radar system 200 in some embodiments. Testing results have confirmed that the array configuration as describe above allows the aperture to still radiate in spite the electrical height being $0.07\times\lambda$ at 830 MHz.

In some embodiments, beam former circuitry 230 is connected directly to each of the radiating elements 206. The intervening volume in an interior region 232 as defined by the outer diameter 234 and the inner diameter 232 houses the active beam forming circuitry 230. The beam former circuitry 230 is analog in nature with amplitude and time delay (or phase shift) adjustment circuit in some embodiments. In some embodiments, the beam former circuitry 230 can utilize digital beam forming (DBF) circuits where either direct digital I/Q sampling (e.g., pure DBF) RF down conversion occurs immediately behind each radiating element 206 (hybrid DBF) and radiation beams are formed through DBF techniques. In some embodiments, the beam former circuitry includes arrays of phase shifters 246 and variable gain amplifiers 248 for effecting DBF.

The specific values of the array parameters described above are exemplary. These parameters may vary based on the operating frequencies supported by the antenna system 200. Furthermore, additional parameters such as the outer diameters d of the conductive substrates 202 and 204 may also be defined. In some embodiments, the outer diameters d of the conductive substrates 202 and 204 may be configured to be approximately 2 feet long, having approximately 1 inch tall BAVA elements evenly disposed (approximately 1.2 inches apart from each other) along the edges of the conductive substrates 202 and 204. The BAVA elements can have the structure as described in U.S. patent application Ser. No. 13/494,517 incorporated herein by reference in its entirety. Coincident phase center BAVA elements are discussed in U.S. Pat. Nos. 8,736,504 and 9,455,500, incorporated herein by reference in their entireties.

Ultra-wide band (UWB) operation is possible from an electrically large two dimensional aperture. Utilizing the parallel plate waveguide, UWB may be achieved using a single row/array of antenna elements 206 (e.g., BAVA elements). In some embodiments, additional antenna arrays (e.g., similar to the antenna system 200) are stacked on top of the antenna system 200.

Figure 4:
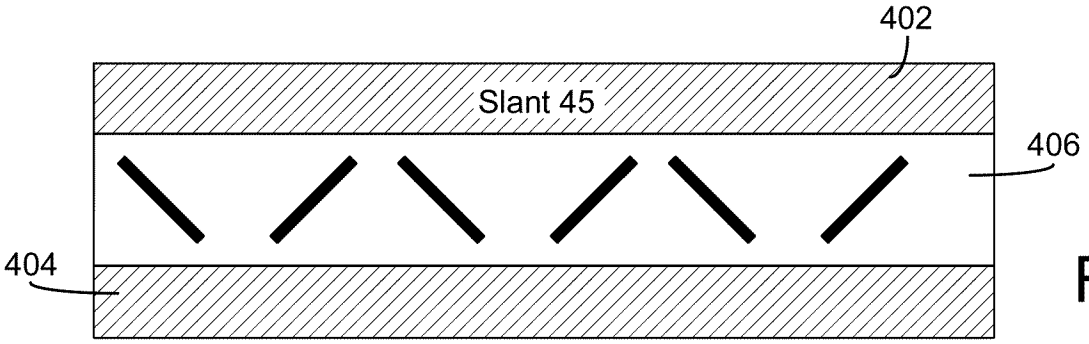
FIG. 4 is a schematic view of showing a layer of BAVA elements for the antenna system illustrated in FIG. 2 according to some embodiments.

With reference to FIG. 4, slanted antenna elements 406 between the conductive medium 402 and the conductive medium 404 are used as the antenna elements 138 and 206 (FIGS. 1 and 2) in some embodiments. The antenna elements 406 are slanted at a 45 degree angle with respect to the planes of the conductive mediums 402 and 404. The conductive mediums 402 and 404 can correspond to the conductive mediums 132 and 134 or 202 and 204 (FIGS. 1 and 2) in some embodiments. Using single slanted antenna elements 406 provides dual linear polarization with single elements decibel (dB) loss (at worst case).

In another embodiment, two of the slanted 45 degree radiating elements 406 can be processed together to create an arbitrary polarization without any polarizations losses. In this embodiment, the spacing h is half the spacing for a single slant 45 degree element 45 for grating lobe-free operation.

Figure 5:
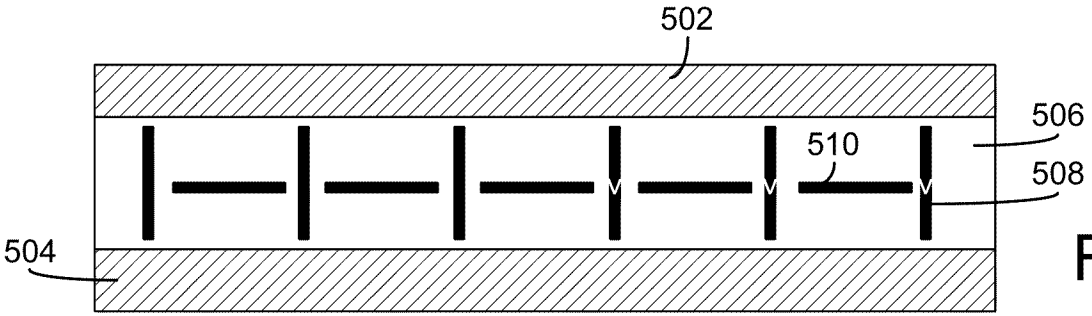
FIG. 5 is a schematic view of showing a layer of BAVA elements for the antenna system illustrated in FIG. 2 according to some embodiments.

With reference to FIG. 5, antenna elements 506 between conductive medium 502 and conductive medium 504 are used as the antenna elements 138 and 206 (FIGS. 1 and 2) in some embodiments. The antenna elements 506 include a vertically polarized element 508 and a horizontally polarized element 510 provided between conductive mediums 502 and 504 which can correspond to the conductive mediums 132 and 134 or 202 and 204 (FIGS. 1 and 2) in some embodiments. The vertically polarized element 508 and a horizontally polarized element 510 are separate elements in some embodiments.

Figure 6:
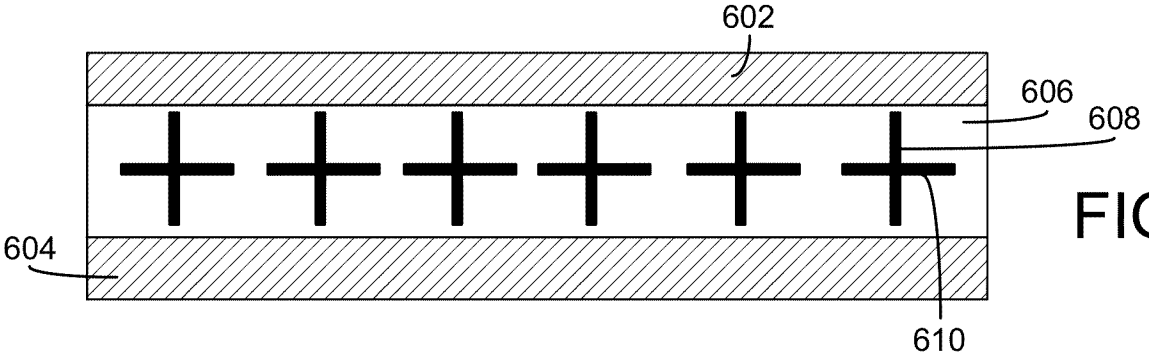
FIG. 6 is a schematic view of showing a layer of BAVA elements for the antenna system illustrated in FIG. 2 according to some embodiments.

With reference to FIG. 6, antenna elements 606 between conductive medium 602 and conductive medium 604 are used as the antenna elements 138 and 206 (FIGS. 1 and 2) in some embodiments. The antenna elements 606 include a horizontally polarized element 608 and a vertically polarized element 610 between conductive mediums 602 and 604 which can correspond to the conductive mediums 132 and 134 or 202 and 204 (FIGS. 1 and 2) in some embodiments. The horizontally polarized element 608 and vertically polarized element 610 are connected to and intersect each other in some embodiments to create coincident phase center DOLP polarized radiating elements to synthesize any arbitrary polarization. Combining adjacent elements 608 and 610 can create arbitrary polarization for the antenna system 100 or 200.

Figure 7:
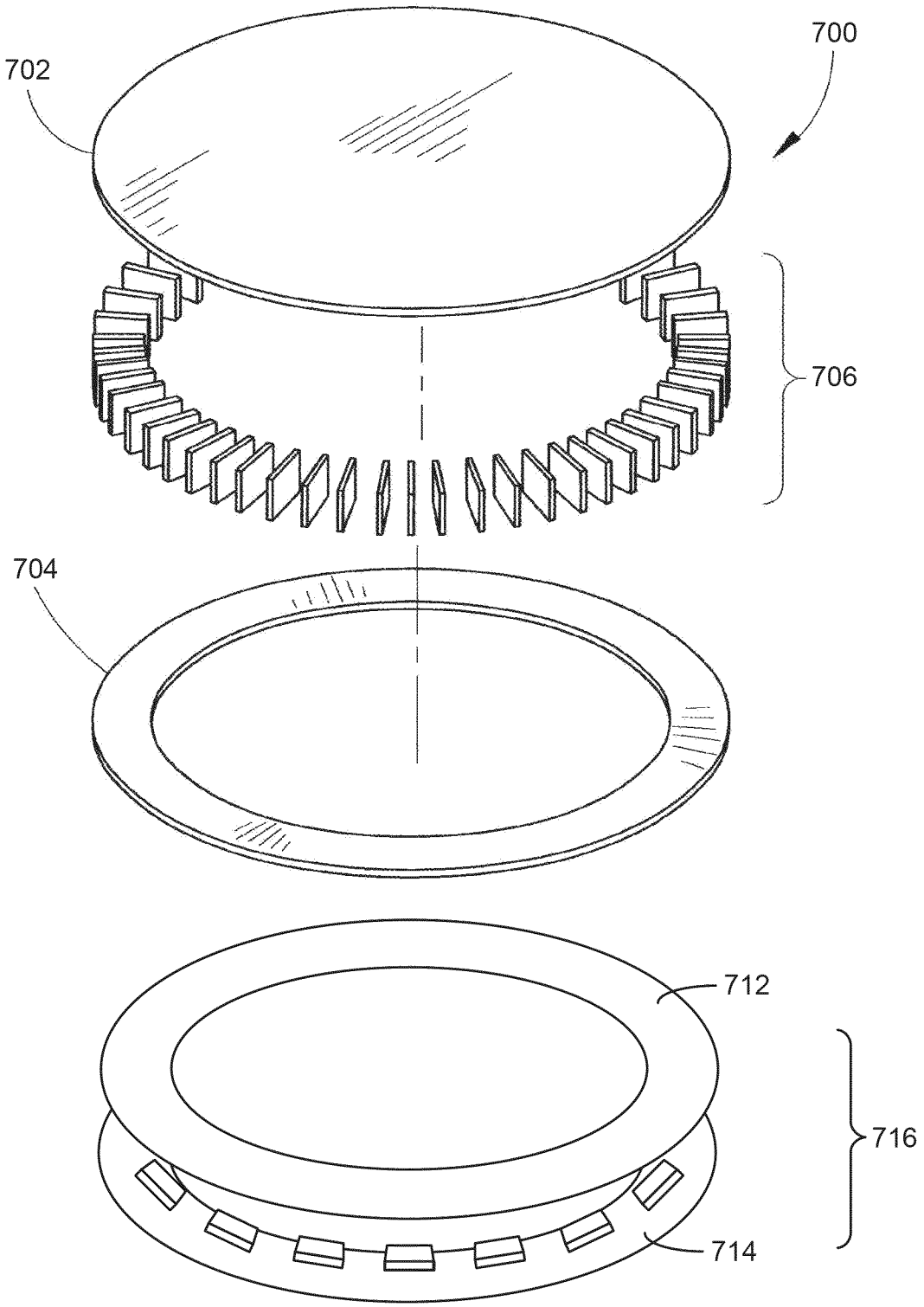
FIG. 7 is an exploded schematic view of an antenna system in accordance with some embodiments.

With reference to FIG. 7, an antenna system 700 includes a conductive medium 702, medium 704 and a conductive medium 714. An additional conductive medium 712 is provided between the mediums 714 and 704 in some embodiments. Conductive mediums 702 and 714 can be configured as hollow ring elements similar to the conductive medium 704 in some embodiments, A row of antenna elements 706 (similar to antenna elements 138 and 206 (FIGS. 1 and 2)) is provided between the conductive mediums 702 and 704. A row of antenna elements 716 (similar to antenna elements 138 and 206 (FIGS. 1 and 2)) is provided between the conductive mediums 712 and 714. The conductive mediums 712 and 704 can be coupled together such that antenna system 700 includes a stack of the antenna elements 706 and 716. An insulative member can be provided between the conductive mediums 704 and 712 in some embodiments. The antenna elements 716 are horizontally polarized and the antenna elements 706 are vertically polarized in some embodiments. Each assembly of antenna elements 706 and 716 can have its own unique beam former circuitry (e.g., the beam former circuitry 220) or can share common beam former assembly circuitry. In some embodiments, beam former circuitry is connected directly to each of the radiating elements 706 and 716 and is disposed in the intervening volume between the conductive medium 702 and 704 and/or between the conductive mediums 712 and 714.

Figure 8:
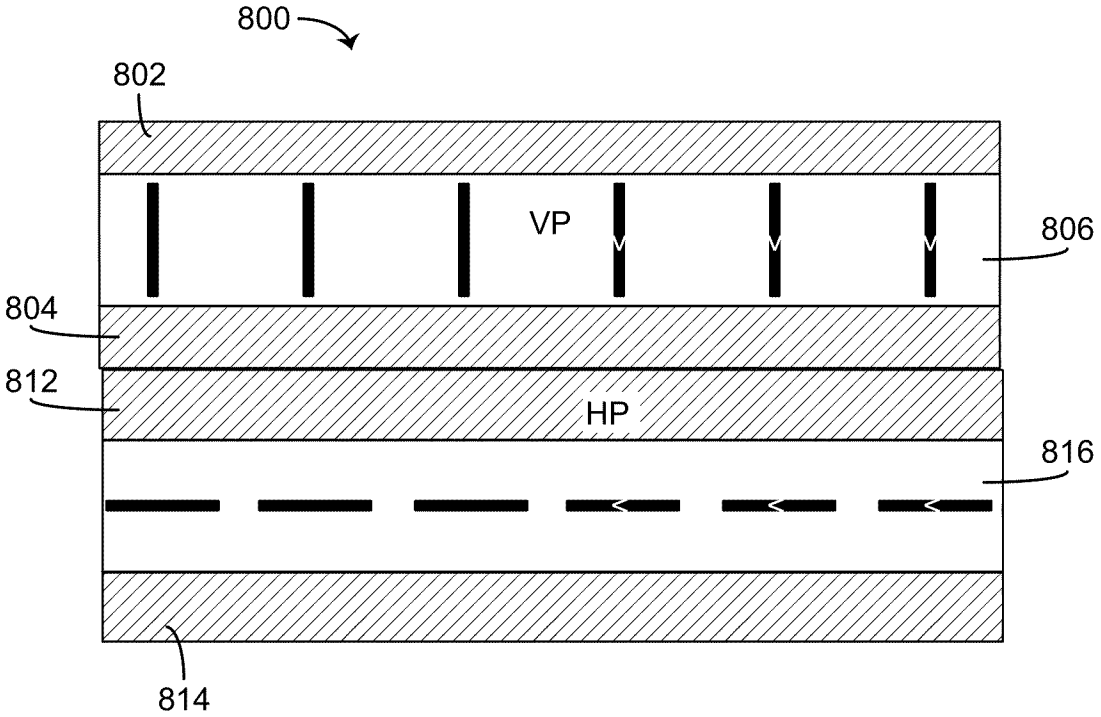
FIG. 8 is a partial schematic cross sectional view showing two layers of BAVA elements for the antenna system illustrated in FIG. 7 according to some embodiments.

With reference to FIG. 8, antenna elements 806 and 816 are used as the antenna elements 706 and 716, respectively, (FIG. 7) in some embodiments. The antenna elements 816 are horizontally polarized elements 608 and the antenna elements 806 are vertically polarized elements. The antenna elements 806 are provided between conductive mediums 802 and 804, and the antenna elements 816 are provided between conductive mediums 812 and 814. An insulating medium is provided between the conductive mediums 804 and 812 in some embodiments. The conductive mediums 804 and 812 are a common metallic assembly in some embodiments.

Figure 9:
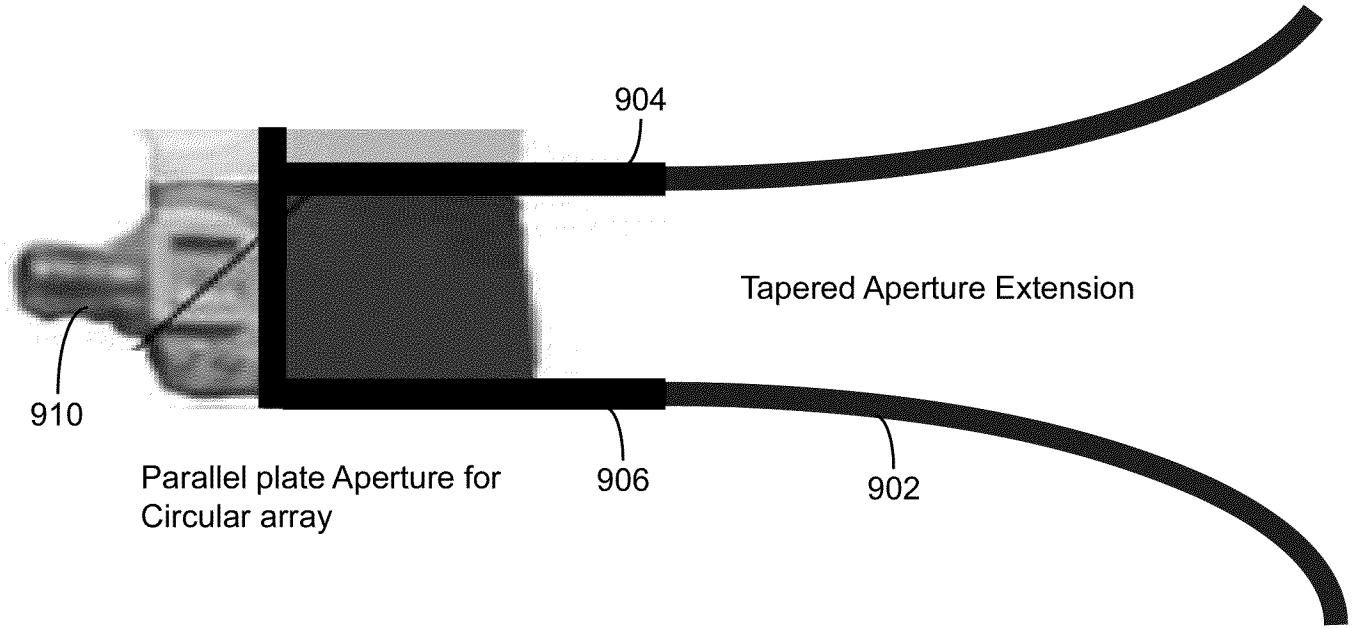
FIG. 9 is a schematic cross sectional view showing a taper extension for the antenna systems illustrated in FIGS. 1, 2, and 7 according to some embodiments.

With reference to FIG. 9, the antenna systems 100, 200 and 700 can utilize a tapered extension 902. The tapered extension 902 is attached to conductive mediums 904 and 906 which can correspond to the conductive mediums 132 and 134 or 202 and 204 (FIGS. 1 and 2) in some embodiments. The tapered extension 902 provides elevation pattern shaping and impedance matching to the horizontally polarized radiating elements. The tapered extension 902 allows the parallel plate region of the conductive mediums 904 and 906 to flare into a horn-like structure so the aperture that touches free space is more sophisticated than two ground planes separated by a distance. The tapered flare provides a better impedance match to free space and allows a narrower elevation beam with that that of a simple parallel plate waveguide structure in some embodiments.

In some embodiments, a coaxial connector 910 is coupled to the antenna element provided between the conductive mediums 904 and 906. In other embodiments, the antenna element directly connects to the beam former circuitry or network as previously described. The tapered extension 902 has flares of arbitrary curvature or multiple curvatures in some embodiments. Top and bottom tapers can be asymmetric or symmetric. In some embodiments, a dual polarized ultra-wideband structure within just one set of ground planes and flares provides both transmit and receive functions.

Figure 10:
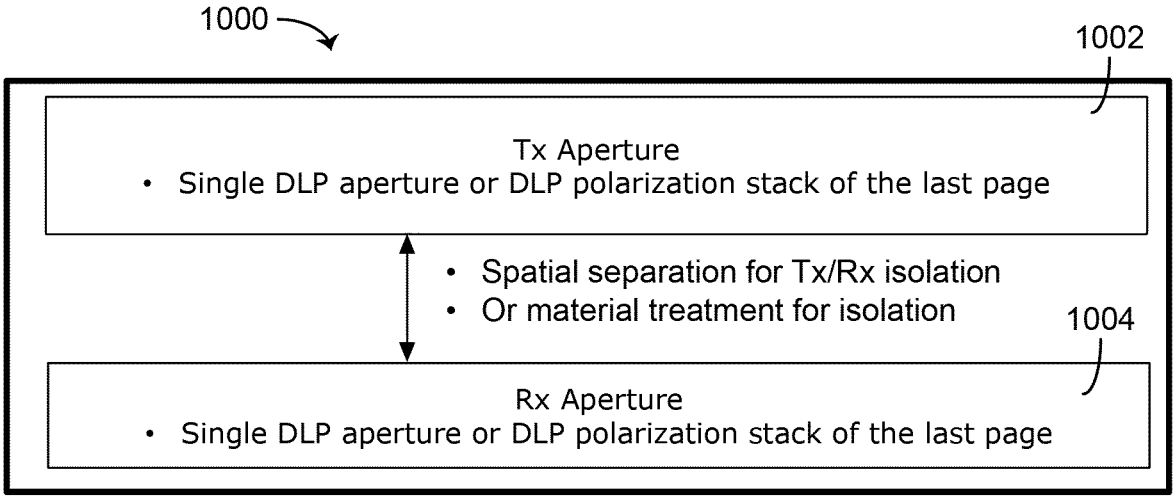
FIG. 10 is a general block diagram of an antenna system with transmit and receive aperture combination according to some embodiments.

With reference to FIG. 10, an antenna system 1000 includes a transmit aperture 1002 stacked above a receive aperture 1004. Transmit aperture 1002 can be a single dual linear polarization (DLP) aperture or DLP polarization stack such as those associated with antenna systems 100, 200, and 700. Receive aperture 1004 can be a single DLP aperture or DLP polarization stack associated with the antenna array 110 or the antenna systems 200, or 700. In some embodiments, the apertures 1002 and 1004 are antenna arrays 110 or antenna systems 200 and 700.

Spatial separation can be provided between apertures 1002 and 1004 for transmit receive isolation. Alternatively, the intervening space between the transmit aperture 1002 and the receive aperture 1004 can utilize various material treated treatments for improved isolation (such as metallic refractors/directors, choke ring high impedance, lossy/absorptive or metamaterial embodiments).

In some embodiments, the apertures 1002 and 1004 are circular arrays that are short in their vertical dimension relative to wavelength. In some embodiments, a transmit vertically polarized array and a transmit horizontally polarized array are disposed on top of one another. In some embodiments, a receive vertically polarized array and a receive horizontally polarized are disposed on top of one another With reference to FIG. 11, an antenna system 1100 includes a transmit aperture or sub-band aperture 1102, and a transmit aperture or sub-band aperture 1104, a receive aperture or sub-band aperture 1106 and a receive aperture or sub-band aperture 1108. Transmit sub-band apertures 1102 and 1104 can be single DLP apertures or DLP polarization stacks and receive sub-band apertures 1106 and 1108 can be single dual linear polarization (DLP) apertures or DLP polarization stacks. In some embodiments, the transmit sub-band apertures 1102 and 1004 and receive sub-band apertures 1106 and 1108 are antenna arrays 110 or antenna systems 200 and 700. Spatial separation can be provided for isolation between individual sub-band apertures 1102 and 1104, and sub-band apertures 1106 and 1108 as well as between sub-band apertures 1104 and 1006. Alternatively, the intervening space between the individual sub-band apertures 1102 and 1104, and sub-band apertures 1106 and 1108 as well as between sub-band apertures 1104 and 1006 can utilize various material treated treatments for improved isolation (such as metallic refractors/directors, choke ring high impedance, lossy/absorptive or metamaterial embodiments).

Figure 11:
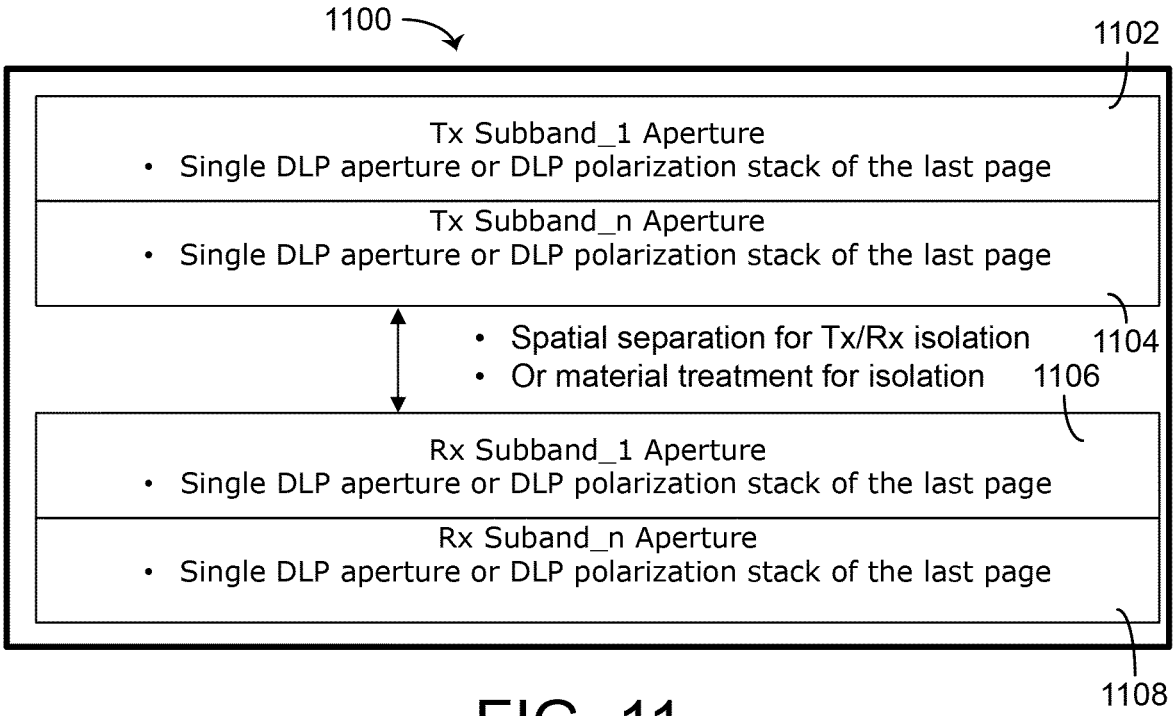
FIG. 11 is a general block diagram of an antenna system with a transmit and receive aperture combination according to some embodiments.

The antenna system 1100 can include a number of transmit sub-band apertures 1102 and 1104 as well as receive sub-band apertures 1106 and 1108. Although two receive and transmit sub-band apertures are shown in FIG. 11, other numbers can be utilized. Each of the sub-bands apertures 1102, 1104, 1106 and 1008 can be configured for a particular frequency band.

In some embodiments, the antenna systems 100, 200, 700, 1000, and 1100 provide a communication antenna for directional networking for low probability of intercept (LPI) and low probability of detection (LPD) at a frequency of 850 MHz to 5 GHz. In some embodiments, antenna systems 100, 200, 700, 1100, and 1000 provide a multifunctional electronic warfare antenna operating at a frequency of 120 MHz to 6 GHz. The antenna systems 100, 200, 700, 1000, and 1100 can be readily scaled in frequency to operation at either lower or higher frequency bands and manufactured according various fabrication techniques.

In some embodiments, the antenna systems 100, 200, 700, 1000, and 1100 provide an ultra-wideband aperture that enables simultaneous omni and directional beams, either by use of a digital beam former or ultra-wideband analogue beam former. In some embodiments, ground plane shaping or RF choking and material or metamaterial loading is used to improve transmit to receive isolation in closely located but separate transmit and receive arrays. Maximizing isolation between the transmit array and the receive array coaxially sitting on top of each other but with a gap between them improves performance in some embodiments where the Tx and Rx array feature a radiation pattern "null in the axis through the center of the array that is perpendicular to 202/204.

While the exemplary embodiments above have the conductive substrate 202 as a disc-shaped conductive substrate, it is contemplated that the conductive substrate 202 may also be configured as a ring-shaped conductive substrate in an alternative embodiment. In such a configuration, it is further contemplated that the inner diameter of the conductive substrate 202 may or may not coincide with the inner diameter of the conductive substrate 204. Furthermore, it is contemplated that a plurality of unit cells may be utilized to form a radar system having a circular BAVA array in accordance with the present disclosure.

It is also contemplated that the BAVA array in accordance with the present disclosure is not limited to a circular configuration. Various other continuous shapes such as ellipses, ovals or the like may be formed and may function similarly as previously described. It is also contemplated that the interior volume defined by the BAVA array may be utilized for feed-related electronics and circuitry, therefore further reducing the physical profile of the overall radar system. Circular and cylindrical arrays can also be approximated by the sum of linear or planar faceted "subarrays" (e.g., a circular array can be approximated by several short linear arrays as a piece wise linear approximation to a circular curve). Furthermore a pure cylindrical array can be approximated as a collection of planar subarray facets. In some embodiments, the antenna systems 100, 200, 700, 1000, and 1100 include multiple radiating elements in the z (vertical) dimension between the ground planes to form cylindrical arrays between the ground planes. For example, more than one radiating element is disposed in the vertical dimension of the antenna systems 100, 200, 700, 1000, and 1100 described with reference to FIGS. 2, 3, 4, 5, 6, 7, 8, 9, 10 and 11. Furthermore, various beam shaping techniques may be applied to the BAVA array to control scanning, beam width, side lobe levels and the like. The beam shaping can be performed by analog or digital beam shaping circuits disposed within the array.

It is contemplated that the antenna/radar system in accordance with the present disclosure may be installed on a size-constrained platform and utilized as a common shared asset aperture, providing multifunctional, multi-beam support to facilitate multiband communications. For example, an unmanned aerial vehicle (UAV) can be equipped with multiple narrow band antenna systems (e.g., UHF, L, S and C band antennas).

In addition to reducing antenna count, the radar systems using the antenna systems 100, 200, 700, 1000, and 1100 also lower the power consumption and its radar signature, which is advantageous in various operating conditions. Furthermore, it is noted that the main beam in the E-plane of the array may be slightly tilted. Such a configuration may be suitable for an UAV that needs to establish a link with ground troops in the far horizon. It is also noted that the radiation pattern of the array in the H-plane may be directive with low side-lobes and deep nulls, providing a very good protection from jamming. In addition, it is understood that the particular location of the radar system 600 is merely exemplary. The antenna systems 100, 200, 700, 1000, and 1100 may be mounted on the bottom of the platform as well as other suitable locations without departing from the spirit and scope of the present disclosure.

It is understood that while the detailed drawings, specific examples, equations, steps, and particular values given provide one exemplary embodiment of the present invention, the exemplary embodiment is for the purpose of illustration only. The method and apparatus of the invention is not limited to the precise details and conditions disclosed. For example, although specific types of images and shapes are shown, other configurations can be utilized. Various changes may be made to the details disclosed without departing from the spirit of the invention which is defined by the following claim.

What is claimed is:

1. An arbitrary polarization circular or cylindrical antenna array, comprising:

a first conductive substrate having a disc-shape;

a second ring-shaped conductive substrate being positioned generally parallel with respect to the first conductive substrate, the second conductive substrate having an outer diameter generally coinciding with an outer diameter of the first conductive substrate; and a plurality of Balanced Antipodal Vivaldi Antenna (BAVA) elements disposed between the first conductive substrate and the second conductive substrate, the BAVA elements forming a circular antenna array along edges of the first conductive substrate and the second conductive substrate, the first conductive substrate and the second conductive substrate jointly forming a parallel plate waveguide for the circular antenna array, wherein the BAVA elements are disposed at a slant angle with respect to the first conductive substrate, wherein the BAVA elements are disposed perpendicular to the first conductive substrate, or wherein the BAVA elements comprise a first element disposed at a first angle with respect to the first conductive substrate and a second element disposed at a second angle with respect to the first conductive substrate different from the first angle.

2. An arbitrary polarization circular or cylindrical antenna array, comprising:

a first conductive substrate;

a second conductive substrate being positioned generally parallel with respect to the first conductive substrate, the second conductive substrate having an outer diameter generally coinciding with an outer diameter of the first conductive substrate;

a plurality of Balanced Antipodal Vivaldi Antenna (BAVA) elements disposed between the first conductive substrate and the second conductive substrate, the BAVA elements forming a circular antenna array along edges of the first conductive substrate and the second conductive substrate, the first conductive substrate and the second conductive substrate jointly forming a parallel plate waveguide for the circular antenna array, wherein the BAVA elements are disposed at a slant angle with respect to the first conductive substrate, wherein the BAVA elements are disposed perpendicular to the first conductive substrate, or wherein the BAVA elements comprise a first element disposed at a first angle with respect to the first conductive substrate and a second element disposed at a second angle with respect to the first conductive substrate different from the first angle; and at least one tapered extension extending from at least one of the first conductive substrate and the second conductive substrate.

3. The antenna array of claim 2, wherein two adjacent BAVA elements of the plurality of the BAVA elements are placed approximately 1.2 inches apart, wherein the outer diameters of the first conductive substrate and the second conductive substrate are between 2 and 4 feet, wherein a distance between the first conductive substrate and the second conductive substrate is approximately 1 inch, and the first conductive substrate has a disc shape and the second conductive substrate has a ring shape.

4. The antenna array of claim 1, wherein the BAVA elements are disposed perpendicular to the first conductive substrate.

5. The antenna array of claim 1, wherein each BAVA element is slanted at a 45 degree angle.

6. The antenna array of claim 1, wherein the BAVA elements each comprise the first and second elements, wherein the first elements are disposed in a first row and second elements are disposed in a second row, the first row being distinct from the second row.

7. An arbitrary polarization circular or cylindrical antenna array, comprising:

a first conductive substrate;

a second conductive substrate being positioned generally parallel with respect to the first conductive substrate, the second conductive substrate having an outer diameter generally coinciding with an outer diameter of the first conductive substrate;

a plurality of Balanced Antipodal Vivaldi Antenna (BAVA) elements disposed between the first conductive substrate and the second conductive substrate, the BAVA elements forming a circular antenna array along edges of the first conductive substrate and the second conductive substrate, the first conductive substrate and the second conductive substrate jointly forming a parallel plate waveguide for the circular antenna array, wherein the BAVA elements are disposed at a slant angle with respect to the first conductive substrate, wherein the BAVA elements are disposed perpendicular to the first conductive substrate, or wherein the BAVA elements comprise a first element disposed at a first angle with respect to the first conductive substrate and a second element disposed at a second angle with respect to the first conductive substrate different from the first angle; and wherein the BAVA elements each comprise the first and second elements, wherein the first elements are disposed in a first row and second elements are disposed in a second row, the first elements in the first row being in a distinct orientation from the second elements in the second row, wherein the first and second elements intersect.

8. An antenna system, comprising:

a first conductive substrate having a disc-shape;

a second ring-shaped conductive substrate being positioned generally parallel with respect to the first conductive substrate, the second conductive substrate defining an outer perimeter that generally coincides with an outer perimeter of the first conductive substrate;

a third conductive substrate defining an outer perimeter that generally coincides with the outer perimeter of the first conductive substrate;

a first row of Balanced Antipodal Vivaldi Antenna (BAVA) elements disposed between the first conductive substrate and the second conductive substrate; and a second row of BAVA elements disposed between the third conductive substrate and the second conductive substrate.

9. The system of claim 8, wherein the first row of BAVA elements forms at least one of: a circular antenna array, an elliptical antenna array or an oval-shaped antenna array and beam forming electronics are disposed between the first conductive substrate and the second conductive substrate within a diameter associated with the first row of BAVA elements.

10. The system of claim 8, wherein a distance between the first conductive substrate and the second conductive substrate is determined based on a lowest operating frequency supported by a radar system using the antenna system.

11. The system of claim 10, wherein the distance is approximately 1 inch.

12. The system of claim 10, wherein the distance is approximately 1.2 inches.

13. The system of claim 8, wherein each of the first row of BAVA elements is horizontally polarized.

14. The system of claim 8, wherein the system is configured to provide more than one polarization.

15. An antenna system, comprising:

a first transmit aperture comprising:

a first conductive substrate having a disc-shape;

a second ring-shaped conductive substrate being positioned generally parallel with respect to the first conductive substrate, the second conductive substrate defining an outer perimeter that generally coincides with an outer perimeter of the first conductive substrate; and first Balanced Antipodal Vivaldi Antenna (BAVA) elements disposed between the first conductive substrate and the second conductive substrate; and a second receive aperture stacked with respect to the transmit aperture and comprising:

a third conductive substrate;

a fourth conductive substrate generally parallel to the third conductive substrate; and second BAVA elements disposed between the third conductive substrate and the fourth conductive substrate.

16. The system of claim 15, wherein the first BAVA elements form at least one of: a circular antenna array, an elliptical first antenna array or an oval-shaped antenna array.

17. The system of claim 15, further comprising:

an isolation material between the second conductive substrate and the third conductive substrate.

18. The system of claim 15, further comprising:

another transmit aperture stacked with respect to the first transmit aperture; and another receive aperture stacked with respect to the second receive aperture.

19. The system of claim 18, wherein an intervening space between the first transmit aperture and the second receive aperture comprises material treated treatments for improved isolation.

20. The system of claim 15, wherein the first and second BAVA elements are configured for dual polarization.

* * * * *